US011453970B2

(12) United States Patent
Bicic

(10) Patent No.: US 11,453,970 B2
(45) Date of Patent: Sep. 27, 2022

(54) DOOR-LOCK FOR HOME APPLIANCES

(71) Applicant: Illinois Tool Works Inc., Glenview, IL (US)

(72) Inventor: Bojan Bicic, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 286 days.

(21) Appl. No.: 16/760,801

(22) PCT Filed: Nov. 27, 2018

(86) PCT No.: PCT/US2018/062563
§ 371 (c)(1),
(2) Date: Apr. 30, 2020

(87) PCT Pub. No.: WO2019/108514
PCT Pub. Date: Jun. 6, 2019

(65) Prior Publication Data

US 2021/0180238 A1 Jun. 17, 2021

(30) Foreign Application Priority Data

Nov. 30, 2017 (IT) ..... 102017000138006

(51) Int. Cl.
*D06F 37/42* (2006.01)
*D06F 49/00* (2006.01)
(Continued)

(52) U.S. Cl.
CPC ..... *D06F 37/42* (2013.01); *D06F 49/003* (2013.01); *D06F 39/14* (2013.01); *D06F 2103/40* (2020.02); *D06F 2105/44* (2020.02)

(58) Field of Classification Search
CPC ..... D06F 37/42; D06F 39/14; D06F 49/003; D06F 2103/40; D06F 2105/44
See application file for complete search history.

(56) References Cited

U.S. PATENT DOCUMENTS

2015/0225886 A1 8/2015 Rocchitelli
2017/0145613 A1* 5/2017 Choi ..... E05B 17/2007
(Continued)

FOREIGN PATENT DOCUMENTS

CN 103541614 A 1/2014
CN 103814167 A 5/2014
(Continued)

OTHER PUBLICATIONS

International Preliminary Report on Patentability for PCT/US2018/062563, dated Jun. 2, 2020.
(Continued)

*Primary Examiner* — Joseph L. Perrin
(74) *Attorney, Agent, or Firm* — Boyle Fredrickson, S.C.

(57) ABSTRACT

A door-lock for a home appliance is provided. The door-lock has a cam that cooperates with a hook and can rotate between two end positions and an intermediate hook holding position. A locking slider cooperates with the cam to lock it and an actuator-controlled locking pin can lock the locking slider. A switch is switchable between open and closed positions, respectively corresponding to the unlocking and locking positions of the locking pin. A cam support carries a trigger element and/or base plate and has a stop that locks the locking slider. A portion of the cam disengages the trigger element from the locking slider when the cam is in an end position opposite a hook release position. The locking slider can rotate beyond the cam locking position to push the locking pin toward the unlocking position with a protrusion when the trigger element is disengaged from the locking slider.

5 Claims, 6 Drawing Sheets

(51) Int. Cl.

| | |
|---|---|
| ***D06F 103/40*** | (2020.01) |
| ***D06F 105/44*** | (2020.01) |
| *D06F 39/14* | (2006.01) |

(56) References Cited

U.S. PATENT DOCUMENTS

| | | | | |
|---|---|---|---|---|
| 2017/0211221 | A1* | 7/2017 | Uros | D06F 39/14 |
| 2019/0048619 | A1* | 2/2019 | Bicic | D06F 49/003 |
| 2019/0292714 | A1* | 9/2019 | Bicic | D06F 39/14 |
| 2020/0115843 | A1* | 4/2020 | Milost | D06F 34/20 |

FOREIGN PATENT DOCUMENTS

| | | | |
|---|---|---|---|
| CN | 107109758 | A | 8/2017 |
| DE | 19601228 | A1 | 7/1997 |
| WO | 2013181289 | A1 | 12/2013 |
| WO | 2015187223 | A1 | 12/2015 |
| WO | 2017155627 | A1 | 9/2017 |

OTHER PUBLICATIONS

Written Opinion for PCT/US2018/062563, dated Jun. 2, 2020.
International Search Report for PCT/US2018/062563, dated Nov. 27, 2018.
Written Opinion for PCT/US2018/062563, dated Nov. 27, 2018.

* cited by examiner

DOOR-LOCK FOR HOME APPLIANCES

FIELD OF THE INVENTION

The present invention relates to a door lock for home appliances such as washing machines, laundry dryers and the like.

BACKGROUND OF THE INVENTION

A door lock for household appliances is an electromechanical device designed to lock the door of the machine in a closed position and provided with terminals connected to a control unit of the appliance. Examples of door locks for household appliances are described, for instance, in WO2016102565 and WO2017155627. The devices described in these documents include:

a housing including a cam support and a base plate having an opening for inserting a hook carried by the appliance door, a cam rotating with respect to the cam support around a rotation axis between two opposite end positions and a hook holding position intermediate between said end positions, a locking slider cooperating with the cam and capable of locking the cam in the hook holding position, and an actuator, for instance an electromagnetic actuator, comprising a locking pin capable of locking the locking slider in the cam locking position.

The locking pin is normally associated with a switch that can be switched between an open position and a closed position corresponding to the unlocking position and locking position of the locking pin. The switch provides to the control unit of the appliance a signal indicating the locked door condition when the locking pin is properly engaged with the slider to lock it into the cam locking position. However, in known devices the switch associated with the locking pin may provide information that the door is properly locked when the hook or cam is broken or when the cam is rotated to the lock position in the absence of the hook.

OBJECT AND SUMMARY OF THE INVENTION

The object of the present invention is to provide a door lock for appliances having a safety function that prevents closure of the switch associated with the locking pin in the event of a hook or cam break or when the cam is rotated to the end position in the absence of the hook.

According to the present invention, this object is achieved by a door lock having the features of claim 1.

The claims form an integral part of the teaching given in connection with the invention.

BRIEF DESCRIPTION OF THE DRAWINGS

The present invention will now be described in detail with reference to the accompanying drawings, given as a non-limiting example, in which.

It will be appreciated that for simplicity and clarity of illustration the figures may not be reproduced in the same scale and that in some figures some of the components are not illustrated to simplify the understanding of the figures.

DETAILED DESCRIPTION

Figure 2:
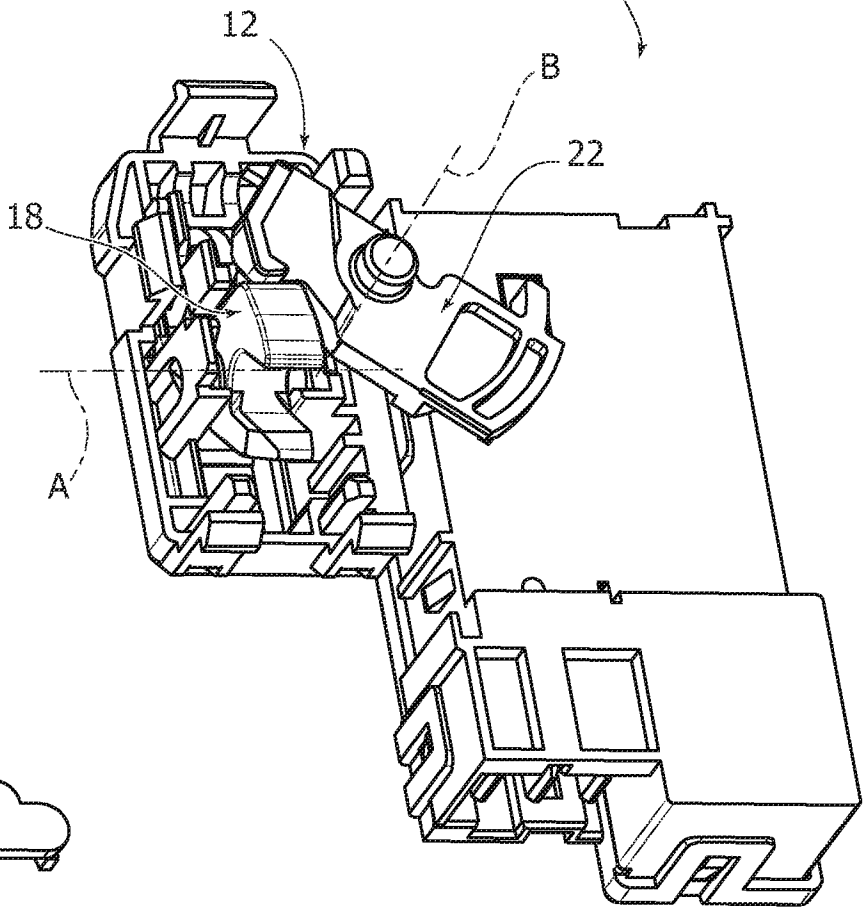
FIG. 2 is a perspective view of a door lock with the base plate removed.
Figure 1:
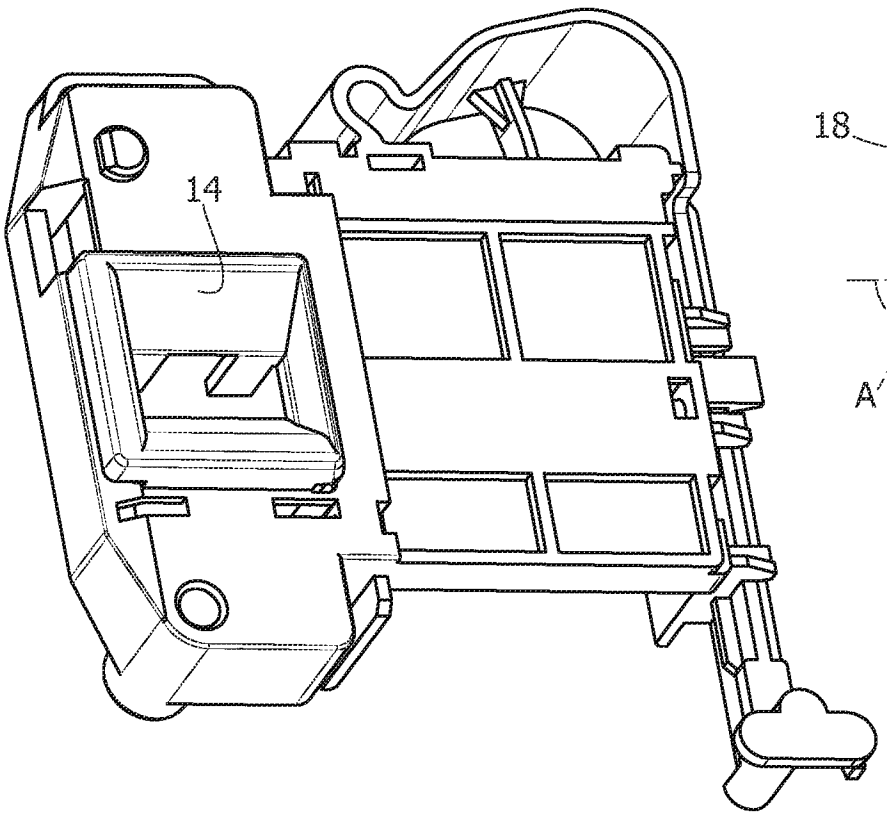
FIG. 1 is a perspective view of a base plate of a door lock according to the present invention.

Referring to FIGS. 1 and 2, the numeral reference 10 indicates a door lock for household appliances, in particular for washing machines, laundry dryers and the like. The door lock 10 comprises a base plate 11 having an opening 14 within which a hook 16 (FIGS. 3-6) carried by the door of the household appliance is intended to be inserted.

Referring to FIGS. 2 and 3 to 5, the door lock 10 comprises a earn 18 rotatably carried by a cam support 12 around a first axis A. The cam 18 has a general C-shape and is intended to engage the hook 16. The cam 18 cooperates with a spring 20 having a bistable function. The spring 20 elastically biases the cam 18 towards two stable end positions shown in FIG. 3 and FIG. 6, respectively. When the hook 16 engages the cam 18 the cam 18 is held in position intermediate between said stable end positions, shown in FIGS. 4 and 5. The cam 18 has a protrusion 50 whose function will be described in the following.

Referring to FIGS. 2-6, the door lock 10 comprises a locking slider 22 rotatable with respect to the cam support 12 about a second axis B transverse with respect to the first axis A. The locking slider 22 cooperates with a second spring 24 that elastically biases the locking slider 22 in the direction indicated by arrow C.

Referring to FIGS. 3-6, the door lock 10 comprises a trigger element 26 carried by the cant support 12 and/or base plate 11. The trigger element 26 forms a stop against which the locking slider 22 abuts under the elastic force of the spring 24. As shown in detail in FIG. 7, the locking slider 22 has a projection 28 that comes into contact with a corresponding projection 30 of the trigger element 26. The trigger element 26 may be connected to the cam support 12 and/or base plate 11 by means of a yielding connection portion, for example of flexible plastic material. The trigger element may be molded integrally with the cam support 12 and/or base plate 11.

Figure 8:
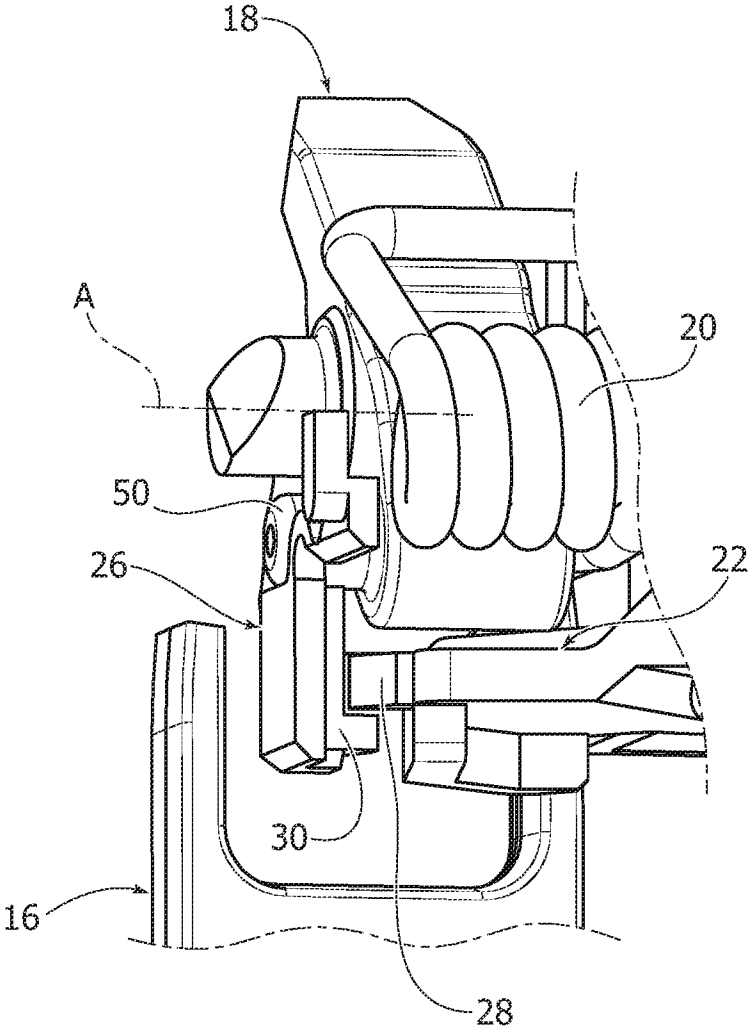
FIGS. 7 and 8 are enlarged details of the parts indicated by arrows VII and VIII in FIGS. 5 and 6.

When the cam 18 or the hook 16 break or when the user inserts an object through opening 14, the trigger element 26 is displaced from a stop position shown in FIG. 7 to a release position shown in FIG. 8, as will be described in the following. In the stop position, the projection 30 of the trigger element 26 interferes with the projection 28 of the locking slider 22 and forms a stop for the locking slider 22. In the release position shown in FIG. 8, the projection 30 of the trigger element 26 is disengaged from the projection 28 of the locking slider 22 and allows the locking slider 22 to rotate around the axis B in the direction indicated by the arrows C in FIGS. 3-6 beyond the hook holding position in the normal working condition of the appliance.

The door lock 10 comprises a locking pin 32 capable of locking the locking slider 22 and consequently the cam 18 when the locking slider 22 and the cam 18 are in a locking position. The locking pin 32 is movable along a straight line between an unlocking position and a locking position, and vice versa. The direction along which the locking pin 32 is movable may be parallel to the axis B around which the locking slider 22 is rotatable. The movement of the locking pin 32 along a direction D1 between the unlocking position and the locking position is controlled by an actuator 34, which may be an electromagnetic actuator. The actuator 34 drives a transmission element 36 which is movable in a rectilinear direction orthogonal to direction D1. The transmission element 36 is connected to the locking pin 32 by means of a ramp surface 38 (FIGS. 5 and 6) that moves the locking pin 32 as a result of the movement of the transmission element 36 in the direction E.

The door lock 10 comprises a switch 40 that can be switched between an open position and a closed position, indicative of the unlocked/locked door status, respectively. The switch 40 comprises a fixed contact 42 and a movable contact 44 having a contact rivet 45. The movable contact 44 may be formed by a flexible lamina which normally keeps the contact rivet 45 in contact with the fixed contact 42.

The movable contact 44 is engaged with the locking pin 32. The switch 40 is in an open position when the locking pin 32 is in the release position (FIGS. 3, 4 and 6) and is in a closed position when the locking pin 32 is in the locking position (FIG. 5). The switch 40 has two or more terminals 47, for instance three terminals, which are intended to be connected to the control unit of the appliance.

The operation of the door lock 10 is as follows.

Figure 3:
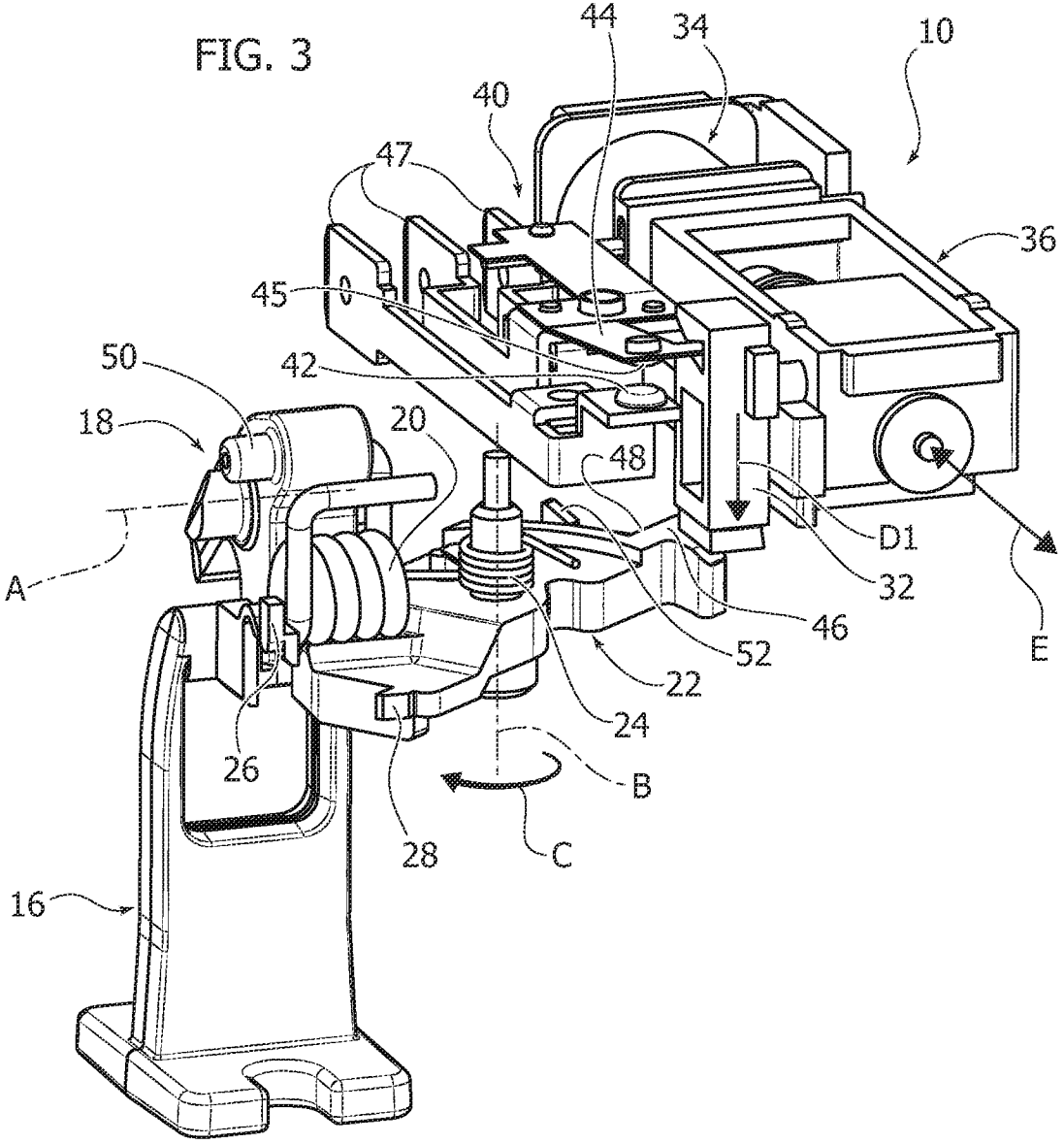
FIG. 3 is a perspective view of the door lock of FIG. 2 in an open-door position with some components removed.

FIG. 3 shows the door lock 10 in the open-door configuration. The hook 16 is disengaged from the cam 18. The cam 18 is held by the spring 20 in the open-door position, in which the open side of the cam 18 is facing the hook insertion opening 14. In this position, the cam 18 holds the locking slider 22 in an unlocking position. In this position, a surface 46 of the locking slider 22 faces a front end of the locking pin 32 and prevents a movement of the locking pin 32 from the unlocking position to the locking position.

Figure 4:
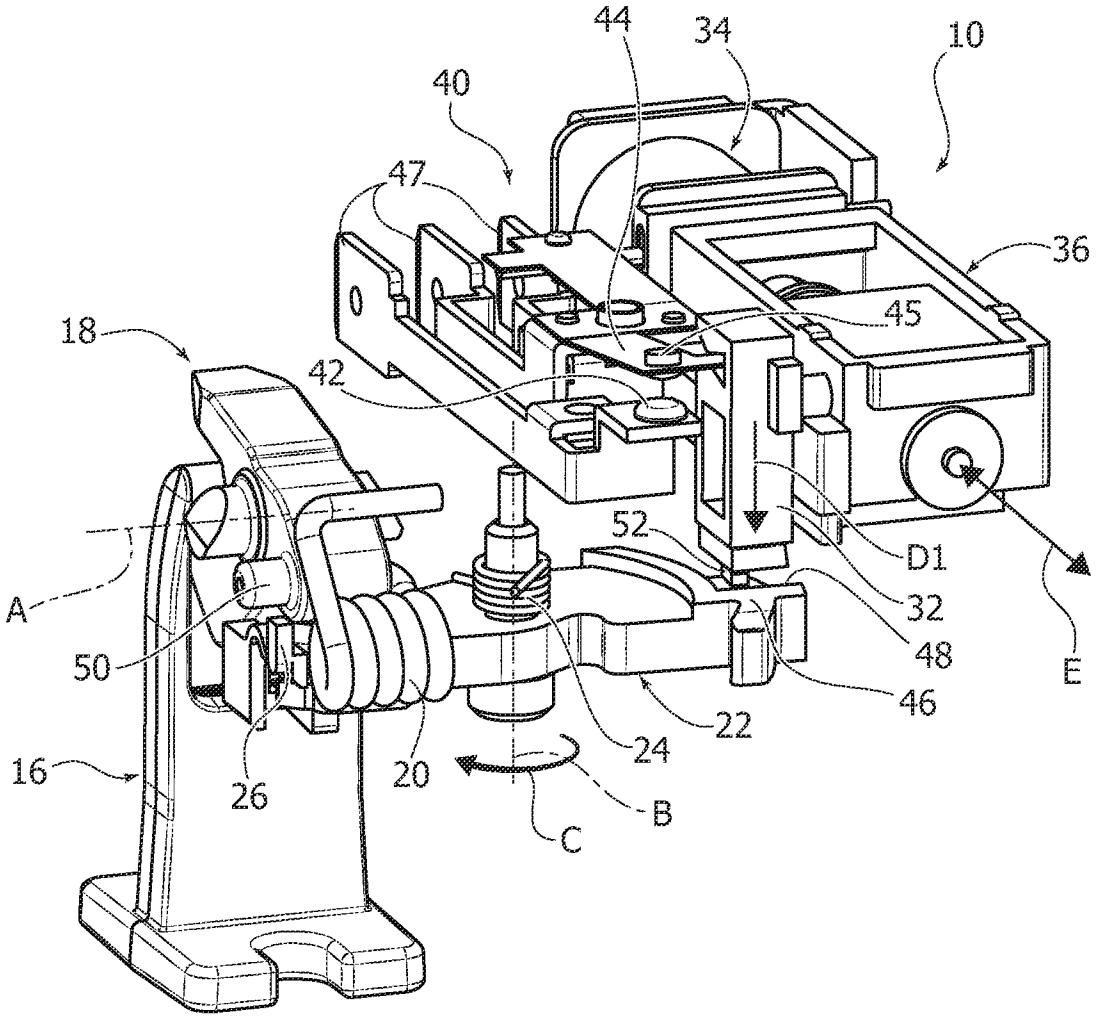
FIG. 4 is a perspective view similar to FIG. 3 illustrating the door lock in a closed and unlocked door position.
Figure 5:
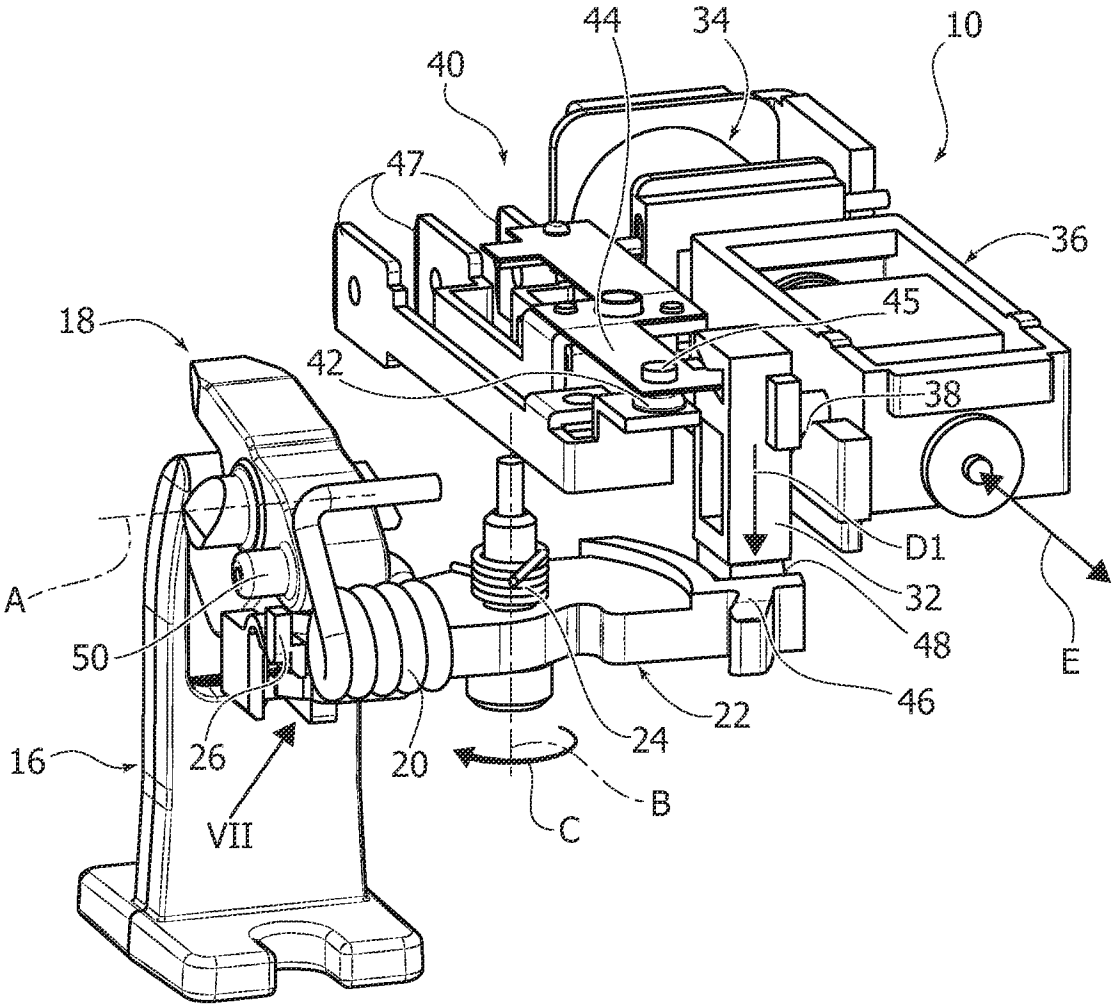
FIG. 5 is a perspective view corresponding to FIGS. 3 and 4 and illustrating the door lock in a closed and locked door position.

FIG. 4 illustrates the position of door lock 10 in the condition where the door is closed but not yet locked. In this condition, the hook 16 engages the cam 18. The hook 16 keeps the cam 18 in an intermediate position between the two stable end positions. The locking slider 22 under the action of the spring 24 rotates in the direction C towards a locking position. In this position, the locking slider 22 abuts against the trigger element 26. A recess 48 of the locking slider 22 faces the front end of the locking pin 32. Therefore, the locking pin 32 is free to move from the unlocking position to the locking position in the direction D1. The locking pin 32 is biased in the direction D1 by the elasticity of the movable contact 44.

When the locking slider 22 is in the configuration of FIG. 4 (closed and unlocked door), activation of the actuator 34 moves the locking pin 32 from the unlocking position (FIG. 4) to the locking position (FIG. 5). In the locking position, the locking pin 32 engages the recess 48 of the locking slider 22 and prevents rotation of the slider 22 around the axis B in the direction opposite to the direction indicated by the arrow C in FIG. 5. In this condition, the locking slider 22 locks the cam 18 and prevents rotation of the cam 18 towards a disengagement position of the hook 16. In this condition, the switch 40 is in the closed position and through the terminals 47 provides to the control unit of the appliance a signal that the door is closed and locked.

Figure 6:
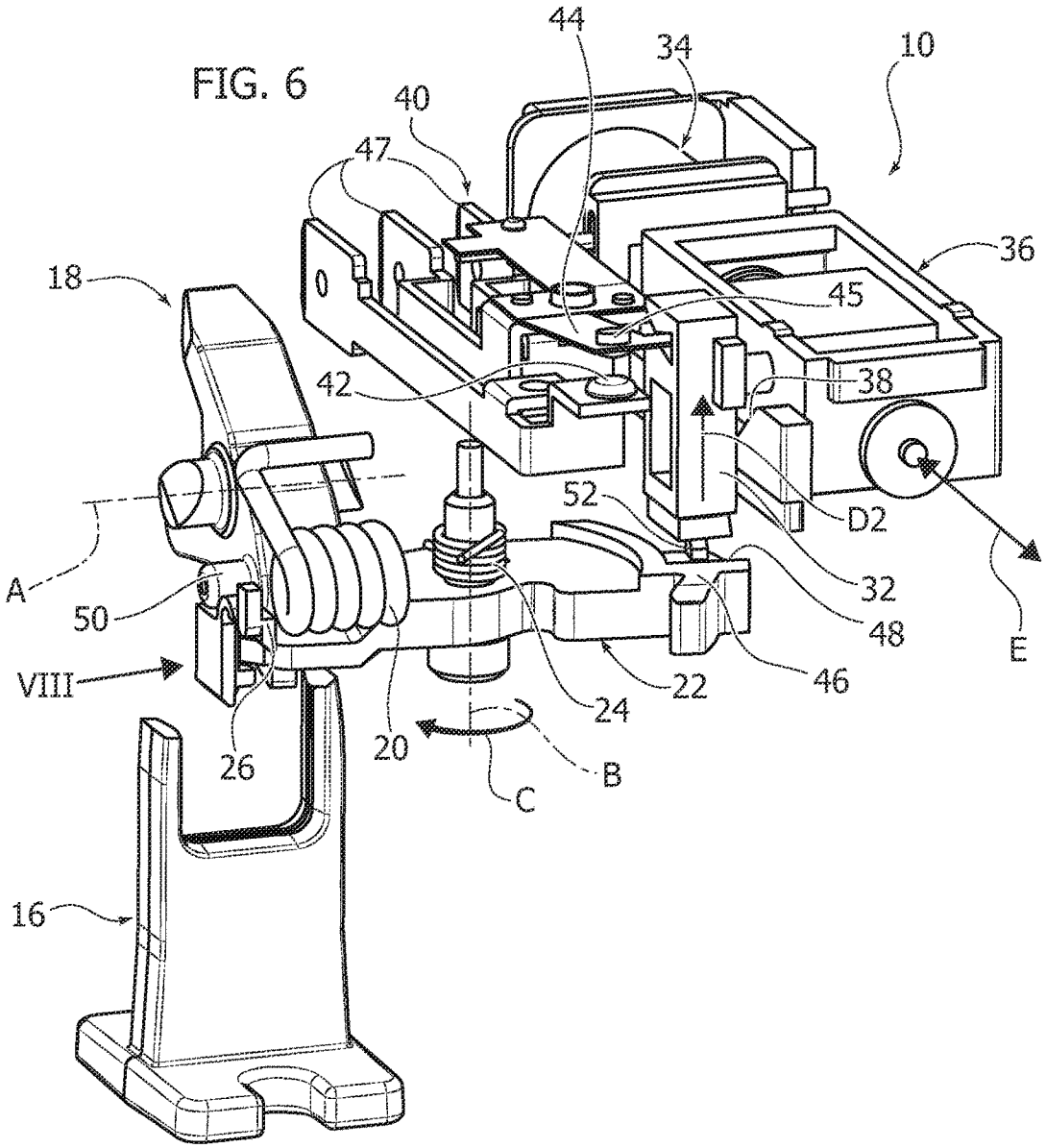
FIG. 6 is a perspective view corresponding to FIGS. 3, 4 and 5 illustrating the door lock in a broken hook/cam position or with the cam rotated in an end position in the absence of the hook.
Figure 7:
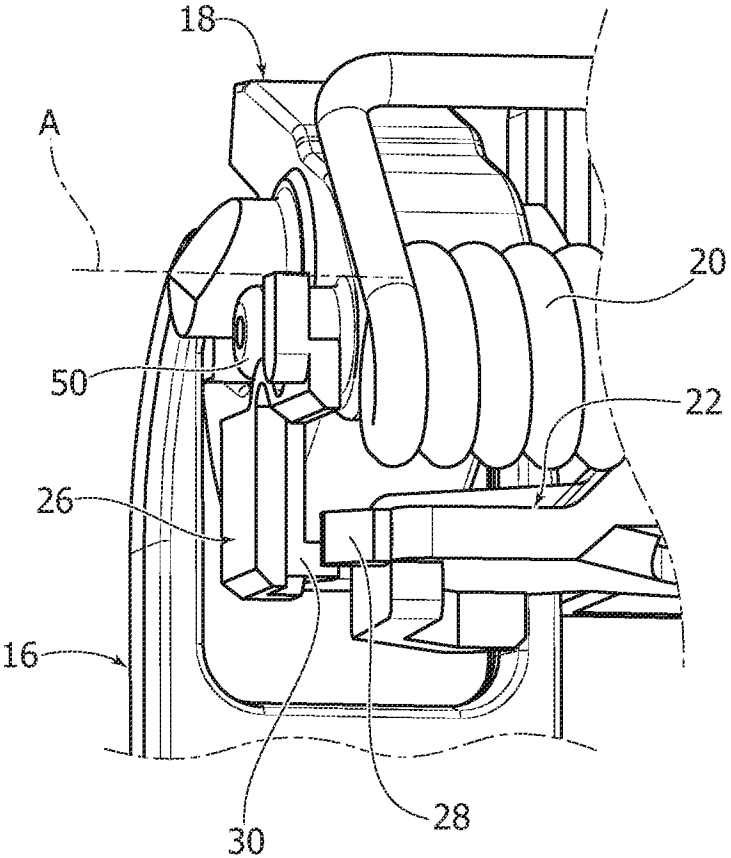

FIG. 6 shows the door lock 10 in a condition in which the hook 16 and/or the cam 18 are broken. The same condition of FIG. 6 is obtained when the cam. 18 is rotated in the absence of the hook 16, for example by inserting a pointed object, such as the tip of a screwdriver, inside the opening 14 of the base plate 11.

In this condition, the cam 18 rotates under the action of the spring 20 beyond the hook holding position illustrated in FIG. 5 and reaches the stable end position opposite the hook release position shown in FIG. 3. When the cam 18 is in the end position shown in FIG. 6, a protrusion 50 of the cam 18 presses on the trigger element 26 and moves the trigger element 26 to the release position shown in FIG. 8. In this position, the locking slider 22 is disengaged from the trigger element 26 and is free to rotate around the axis B in the direction indicated by the arrow C under the action of the spring 24. The further rotation of the locking slider 22 beyond the locking position brings a protrusion 52 of the locking slider 22 in contact with the front end of the locking pin 32 (FIG. 6) and pushes the locking pin 32 to the release position in the direction indicated by D2 in FIG. 6. Therefore, the locking pin 32 opens the switch 40, which signals to the appliance control unit that the door is not locked.

The door lock 10 according to the present invention is therefore provided with an additional safety function which prevents the switch 40 from indicating a door locked state in the case of breakage of the hook 16 and/or of the cam 18 or in the case of rotation of the cam. 18 in the absence of hook 16.

Of course, without prejudice to the principle of the invention, the details of construction and the embodiments can be varied with respect to those illustrated here without departing from the scope of the invention as defined by the attached claims.

The invention claimed is:

1. A door-lock for home appliances, comprising:

a housing including a cam support and a base plate having an opening for inserting a hook carried by an appliance door, a cam cooperating with the hook, rotatable between two end positions and having a hook holding position intermediate between the end positions, a locking slider cooperating with the cam and capable of locking the cam in the hook holding position, a locking pin controlled by an actuator and movable between an unlocking position and a locking position and capable of locking the locking slider a switch cooperating with the locking pin and switchable between an open position corresponding to the unlocking position and a closed position corresponding to the locking position of the locking pin, and trigger element carried by the cam support and/or the base plate and having a first projection for stopping the locking slider, and wherein the cam has a first protrusion configured to disengage the trigger element from the locking slider when the cam is in an end position opposite a hook release position, and wherein in a condition where the trigger element is disengaged from the locking slider, the locking slider is configured to rotate beyond the cam locking position and to push the locking pin towards the unlocking position by means of a second protrusion; and wherein:

a first spring having a bi-stable function biases elastically the rotatable cam towards the two stable end positions around a first axis;

the cam being held by the first spring in the first of the two stable end positions when it is in the hook release position;

the cam being held by the first spring in the hook holding position intermediate between the two stable end positions when the hook is engaged in the cam;

the cam being held by the first spring in the second of the two stable end positions which is opposite the hook release position, beyond the hook holding position;

a second spring cooperates with the locking slider to elastically bias the locking slider rotatably with respect to the cam support from a cam unlocking position towards and beyond a cam locking position around a second axis being transverse with respect to the first axis;

the trigger element being movable between a stop position, wherein a projection of the locking slider abuts under the elastic force of the second spring against the first projection to form a stop for the locking slider in its locking position, corresponding to a locking position of the door with the cam the hook holding position, and a release position, wherein the first projection of the trigger element is disengaged from the projection of the locking slider to allow the locking slider under the action of the second spring to rotate further around the second axis beyond its locking position, whereby by this further rotation of the locking slider the second protrusion carried by the locking slider comes into contact with the locking pin to push it into its unlocking position, leading to an opening of the switch to signal an unlocked state of the door;

whereby the first protrusion of the cam disengages the trigger element from its stop position into its release position when the cam is biased into the second stable end position opposite the hook release position by the force of the first spring, such condition being caused by a breakage of the hook and/or the cam or by a rotation of the cam in the absence of the hook.

2. The door lock according to claim 1, wherein the trigger element is connected to the cam support and/or base plate by means of a yielding portion.

3. The door lock according to claim 2, wherein the yielding portion is fixed or integrally formed with the cam support and/or the base plate.

4. The door lock according to claim 1, wherein the trigger element and the locking slider have respective projections cooperating to each other in the holding position and not cooperating to each other in the releasing position of the trigger element.

5. The door lock according to claim 1, wherein the switch comprises two or more terminals intended to be connected to a control unit of a domestic appliance for providing to said control unit a signal indicating a state of door closed and locked.

* * * * *